US009361822B2

(12) United States Patent
Ho et al.

(10) Patent No.: US 9,361,822 B2
(45) Date of Patent: Jun. 7, 2016

(54) COLOR ADJUSTMENT TECHNIQUES FOR DISPLAYS

(75) Inventors: Kelsey Yukio Ho, Los Altos, CA (US); Abhijit Bhattacharya, Redwood City, CA (US); Christopher William Baldwin, Mountain View, CA (US); Gabriel Gheorghe Marcu, San Jose, CA (US); Jesse Michael Devine, Oakland, CA (US)

(73) Assignee: APPLE INC., Cupertino, CA (US)

( * ) Notice: Subject to any disclaimer, the term of this patent is extended or adjusted under 35 U.S.C. 154(b) by 1106 days.

(21) Appl. No.: 13/292,955

(22) Filed: Nov. 9, 2011

(65) Prior Publication Data

US 2013/0113838 A1 May 9, 2013

(51) Int. Cl.

| | |
|---|---|
| ***G09G 5/10*** | (2006.01) |
| ***G09G 3/20*** | (2006.01) |
| *G09G 3/36* | (2006.01) |

(52) U.S. Cl.

CPC ..... *G09G 3/2003* (2013.01); *G09G 3/36* (2013.01); *G09G 2320/0242* (2013.01); *G09G 2320/0247* (2013.01); *G09G 2320/0271* (2013.01); *G09G 2320/041* (2013.01); *G09G 2330/022* (2013.01)

(58) Field of Classification Search

CPC ..... G09G 2320/0666; G09G 2320/0673
USPC ..... 345/690, 73–104
See application file for complete search history.

(56) References Cited

U.S. PATENT DOCUMENTS

| | | | | |
|---|---|---|---|---|
| 5,489,918 | A | 2/1996 | Mosier | |
| 5,936,604 | A | 8/1999 | Endou | |
| 7,119,775 | B2 | 10/2006 | Ozaki | |
| 7,759,882 | B2 | 7/2010 | Korcharz et al. | |
| 7,868,857 | B2 | 1/2011 | Nathan et al. | |
| 7,982,706 | B2 | 7/2011 | Ichikawa et al. | |
| 8,823,630 | B2 * | 9/2014 | Roberts et al. | 345/102 |
| 2004/0178974 | A1 | 9/2004 | Miller et al. | |

(Continued)

FOREIGN PATENT DOCUMENTS

| | | | |
|---|---|---|---|
| CN | 201063938 | Y | 5/2008 |
| CN | 101377902 | A | 3/2009 |

(Continued)

OTHER PUBLICATIONS

International Search Report and Written Opinion for PCT No. PCT/US2012/057623 dated Jan. 30, 2013; 12 pages.

(Continued)

*Primary Examiner* — Kent Chang
*Assistant Examiner* — Scott Au
(74) *Attorney, Agent, or Firm* — Fletcher Yoder PC

(57) ABSTRACT

The present disclosure relates generally to systems and techniques for applying color adjustments to a display. In certain embodiments, the color adjustment techniques may be employed to transition current color correction values, which are based on a previously detected temperature of the display, to target correction values, which are based on a presently detected temperature of the display. Adjustment increments for each color channel of the display may be determined based on the color channel that has the largest difference between the current color correction value and the target color correction value. In particular, the number of adjustment steps may be determined so that the adjustment increment for each channel is less than or equal to a maximum adjustment increment.

20 Claims, 5 Drawing Sheets

(56) References Cited

U.S. PATENT DOCUMENTS

| | | | | |
|---|---|---|---|---|
| 2009/0027375 | A1 | 1/2009 | Ryu et al. | |
| 2010/0091039 | A1 * | 4/2010 | Marcu et al. | 345/690 |
| 2011/0032275 | A1 | 2/2011 | Marcu et al. | |
| 2011/0057959 | A1 * | 3/2011 | Park et al. | 345/690 |

FOREIGN PATENT DOCUMENTS

| | | | |
|---|---|---|---|
| CN | 201698714 | U | 1/2011 |
| TW | 200630708 | A | 9/2006 |
| TW | 200709133 | A | 3/2007 |
| TW | 201135708 | A | 10/2011 |

OTHER PUBLICATIONS

Chinese Office Action for Chinese Office Action No. 201210520739.6 dated Jul. 9, 2014; 27 pgs.

Office Action for Taiwan Application No. 101136112 dated Feb. 6, 2015; 12 pgs.

* cited by examiner

COLOR ADJUSTMENT TECHNIQUES FOR DISPLAYS

BACKGROUND

The present disclosure relates generally to displays, and more particularly to color adjustment techniques for displays.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Display technology may be used in a wide variety of electronic devices, such as computers, displays, and handheld devices (e.g., mobile phones, media players, and gaming systems). Displays may include liquid crystal displays (LCDs), cathode ray tubes (CRTs), and organic light emitting diode displays (OLED displays), among others. A display typically includes multiple picture elements (e.g., pixels) of certain discrete colors, and the ratios between the discrete colors can be varied to produce virtually any color. For example, each pixel within an LCD may include red, green, and blue subpixels that can emit different amounts of light to produce different colors. A display also typically includes a light source, such as a light emitting diode (LED) backlight or a cold cathode fluorescent light (CCFL) backlight, that provides light for the display.

The color response of a display may change as the display operates. For example, the displays themselves, as well as the various electronic devices that employ displays, may generate heat that can shift the color of the display. In particular, the chromaticity and brightness of the light emitted by the individual pixels or subpixels may vary with temperature, causing the overall color emitted by the display also to vary with temperature. Further, the chromaticity and brightness of the light emitted by the light source also may vary with temperature, which can shift the white point, and therefore the overall color emitted by the display. Color correction adjustments can be employed within the display to compensate for color shifts due to temperature. However, when the display resumes normal operation after a low power mode, such as a sleep or standby mode, the previously applied adjustments may no longer be applicable due to temperature changes that may have occurred during the low power mode.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates generally to techniques for applying color adjustments to a display. Changes in the temperature of a display may cause changes in the color (e.g., the chromaticity and brightness) emitted by the display. Accordingly, displays may employ color correction values to compensate for color shifts due to display temperature changes. In accordance with disclosed embodiments, the displays may detect the temperature and determine appropriate color correction values for individual color channels of the display based on the temperature. The input signals provided to the display may then be adjusted by the color correction values to produce a consistent color as the temperature of the display changes.

In accordance with disclosed embodiments, the color adjustment techniques may be employed to transition the current color correction values, which are based on a previously detected temperature of the display, to target correction values, which are based on a presently detected temperature of the display. When a significant difference exists between a current color correction value and a target color correction value, the color channels may be incrementally adjusted to the target color correction values so that the color adjustment is imperceptible to a user. For example, adjustment increments for each of the color channels may be determined based on the color channel that has the largest difference between the current color correction value and the target color correction value. In particular, the number of adjustment steps may be determined so that the adjustment increment for each channel is less than or equal to a maximum adjustment increment, which in certain embodiments may represent the largest change in color that is generally imperceptible to a user.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
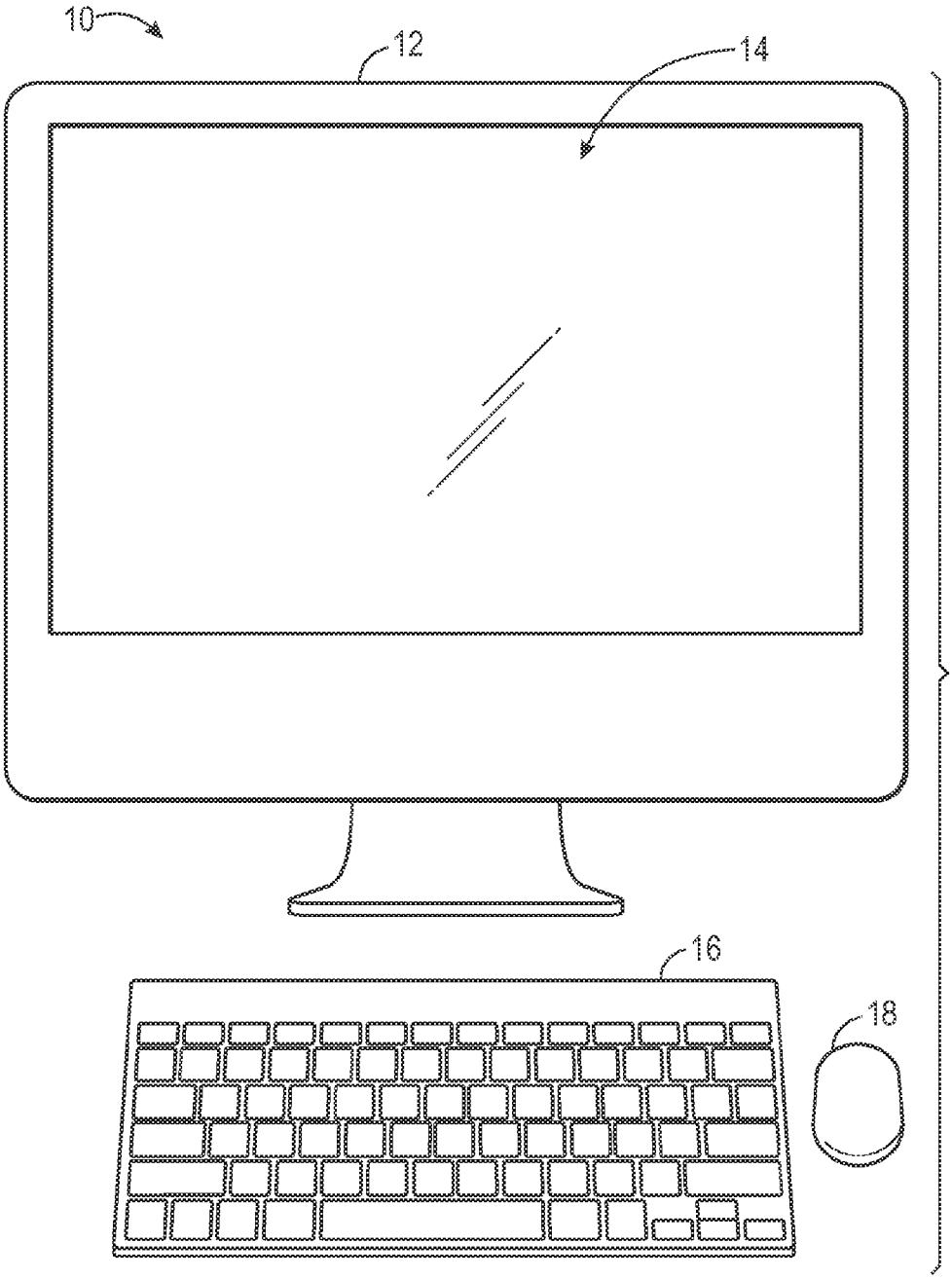
FIG. 1 is a front view of an example of an electronic device, in accordance with aspects of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure generally relates to systems and techniques for applying color adjustments to a display. Within displays, color correction values may be applied to individual color channels of the display to compensate for color shifts that occur due to changes in temperature. The color adjustment techniques described herein may be employed to transition current color correction values to target color correction values when a significant temperature shift has occurred. For example, when a display resumes operation after a low power mode, such as a sleep mode or standby mode, the current color correction values may be based on the temperature of the display prior to entering the low power mode. However, the temperature of the display may decrease while the display is in the low power mode, and therefore a sizeable difference may exist between the current color correction values and the target color correction values. If the target color correction values were to be immediately applied, a visible shift in the color of the display may occur. Therefore, present embodiments provide a technique for transitioning the display to the target color correction values. Further, the techniques may be employed to transition current color correction values to target color correction values at other times when a significant temperature shift has occurred, such as during a significant change in a display's environmental temperature.

According to certain embodiments, a display may include red, green, and blue color channels. In these embodiments, the current color correction values and the target color correction values each may include a red color correction value, a blue color correction value, and a green color correction value, which can be applied to the red, green, and blue color channels, respectively. The difference between the current color correction value and the target correction value for each channel can be determined, and the channel that has the largest difference can be identified. The largest difference can then be compared to a maximum adjustment increment, which in certain embodiments may represent the largest change in color that is generally imperceptible to a user. If the largest difference is equal to or less than the maximum adjustment increment, the target color correction values may be applied in a single step.

However, if the largest difference is greater than the maximum adjustment increment, the color correction values may be adjusted incrementally until the target color correction values are obtained. In particular, the largest difference may be divided by the maximum adjustment increment to determine the number of adjustment steps that should be employed to reach the target color correction values. The differences between the current color correction values and the target correction values for the other color channels may then be divided by the number of adjustment steps to determine size of the adjustment increment for those channels. The color correction values for each channel may then be stepped to the target color correction values using the adjustment increments determined for each channel. Accordingly, each color channel may be adjusted to the target color correction values using the same number of steps while the size of the adjustment increments may vary between the channels.

FIG. 1 illustrates an electronic device 10 that may make use of the color adjustment techniques described above. It should be noted that while the techniques will be described below in reference to illustrated electronic device 10 (which may be a desktop computer), the techniques described herein are usable with any electronic device employing a display. For example, other electronic devices may include a laptop computer, a tablet computer, a viewable media player, a mobile phone, a personal data organizer, a workstation, a standalone display, or the like. In certain embodiments, the electronic device may include a model of an iMac®, Mac® mini, Mac Pro®, MacBook®, a MacBook® Pro, MacBook Air®, Apple Cinema Display®, Apple Thunderbolt Display®, iPad®, iPod® or iPhone® available from available from Apple Inc. of Cupertino, Calif. In other embodiments, the electronic device may include other models and/or types of electronic devices or standalone displays, available from any manufacturer.

As illustrated in FIG. 1, electronic device 10 includes a housing 12 that supports and protects interior components, such as processors, circuitry, and controllers, among others, that may be used to generate images to display on display 14. Electronic device 10 also includes user input structures 16 and 18, shown here as a keyboard and a mouse, that may be manipulated by a user to interact with electronic device 10. For example, user input structures 16 and 18 may be employed to operate a graphical user interface (GUI) and applications running on electronic device 10. Input structures 16 and 18 may be connected to the electronic device 10 through a wired or wireless configuration. Further, in certain embodiments, electronic device 10 may include other types of user input structures, such as a touchscreen or trackpad, among others.

Figure 2:
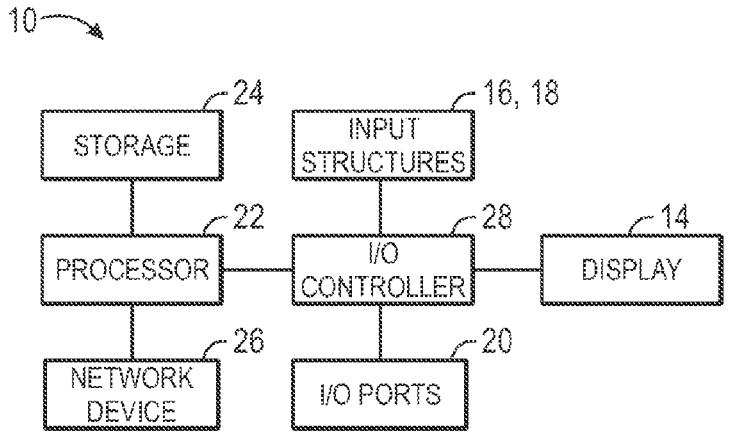
FIG. 2 is a block diagram of an example of components of the electronic device of FIG. 1, in accordance with aspects of the present disclosure.

FIG. 2 is a block diagram illustrating various components and features of device 10. As may be appreciated, the various functional blocks shown in FIG. 2 may include hardware elements (including circuitry), software elements (including computer code stored on a non-transitory, computer-readable medium, such as a hard drive or system memory), or a combination of both hardware and software elements. In addition to display 14 and input structures 16 and 18, which are discussed above, device 10 includes input and output (I/O) ports 20 that allow connection of device 10 to external devices, such as a power source, printer, network, or other electronic device. As shown in FIG. 2, display 14 is an integral part of electronic device 10. However, in other embodiments, display 14 may be a standalone display that may be connected to electronic device 10 through one of the I/O ports 20. For example, in these embodiments, I/O ports 20 may include a DisplayPort, Digital Visual Interface (DVI), High-Definition Multimedia Interface (HDMI), or analog (D-sub) interface.

Device 10 also includes a processor 22 that may control operation of device 10. Processor 22 may use data from a storage 24 to execute the operating system, programs, GUI, and any other functions of device 10. Storage 24 may include non-transitory, computer readable media that stores instructions, programs, and/or code for execution by processor 22. Further, storage 24 may represent random-access memory, read-only memory, rewritable flash memory, hard drives, and optical discs, among others. Processor 22 also may receive data through I/O port 20 or through a network device 26, which may represent, for example, one or more network interface cards (NIC) or a network controller. Information received through network device 26 and I/O port 20, as well as information contained in storage 24, may be displayed on display 14. An input/output (I/O) controller 28 may provide the infrastructure for exchanging data between input structures 16 and 18, I/O ports 20, display 14, and processor 22.

Figure 3:
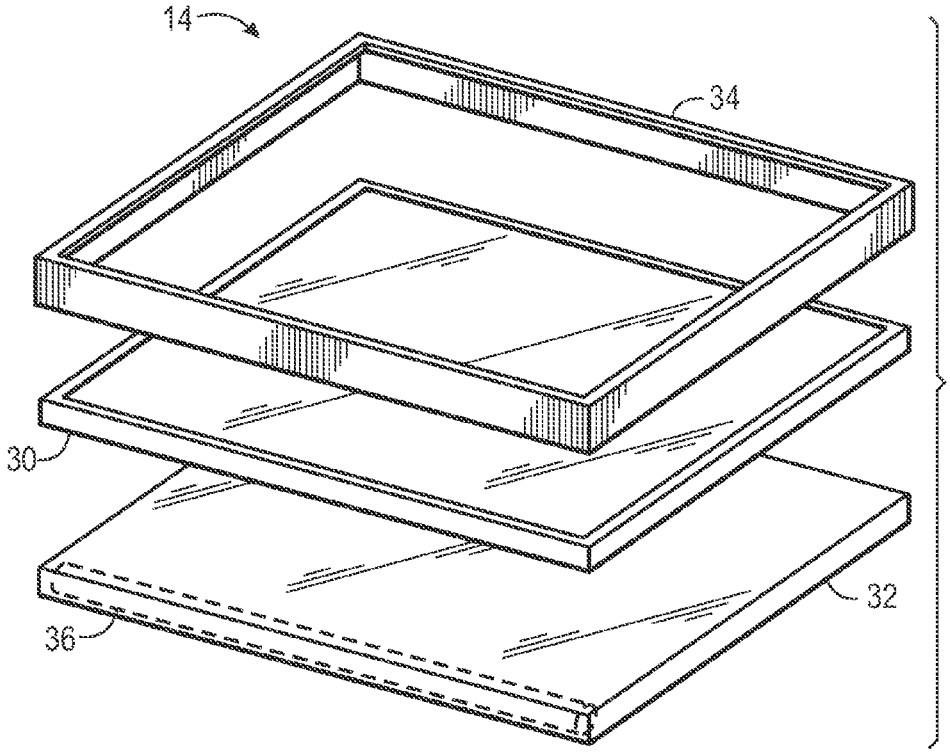
FIG. 3 is an exploded view of the display of FIG. 2, in accordance with aspects of the present disclosure.

FIG. 3 is an exploded view of an embodiment of display 14, which includes an LCD panel 30. Display 14 is generally discussed herein in the context of an LCD display. However, in other embodiments, display 14 may be an OLED display, a CRT display, or any other suitable type of display that includes multiple color channels. Display 14 also includes a backlight 32 that functions as a light source for LCD panel 30, and that is assembled within a frame 34 along with LCD panel 30. LCD panel 30 may include an array of pixels configured to selectively modulate the amount and color of light passing from backlight 32 through LCD panel 30. For example, LCD panel 30 may include a liquid crystal layer, one or more thin film transistor (TFT) layers configured to control orientation of liquid crystals of the liquid crystal layer via an electric field, and polarizing films, which cooperate to enable LCD panel 30 to control the amount of light emitted by each pixel. LCD panel 30 may be a twisted nematic (TN) panel, an in-plane switching (IPS) panel, a fringe-field switching (FFS) panel, variants of the foregoing types of panels, or any other suitable panel.

Backlight 32 includes one or more light sources 36, as well as other components such as a light guide and optical films that may direct light from light source 36 toward LCD panel 30. In various embodiments, light source 36 may include a cold-cathode fluorescent lamp (CCFL), one or more LEDs, OLEDs, or any other suitable source of light. As shown in FIG. 3, backlight 32 is an edge-lit backlight that includes one light source 36 located at an edge of display 14. However, in other embodiments, multiple light sources 36 may be disposed around the edges of display 14. Further, in certain embodiments, instead of an edge-lit backlight, the backlight may be a direct-light backlight with one or more light sources 36 mounted behind the LCD panel.

Figure 4:
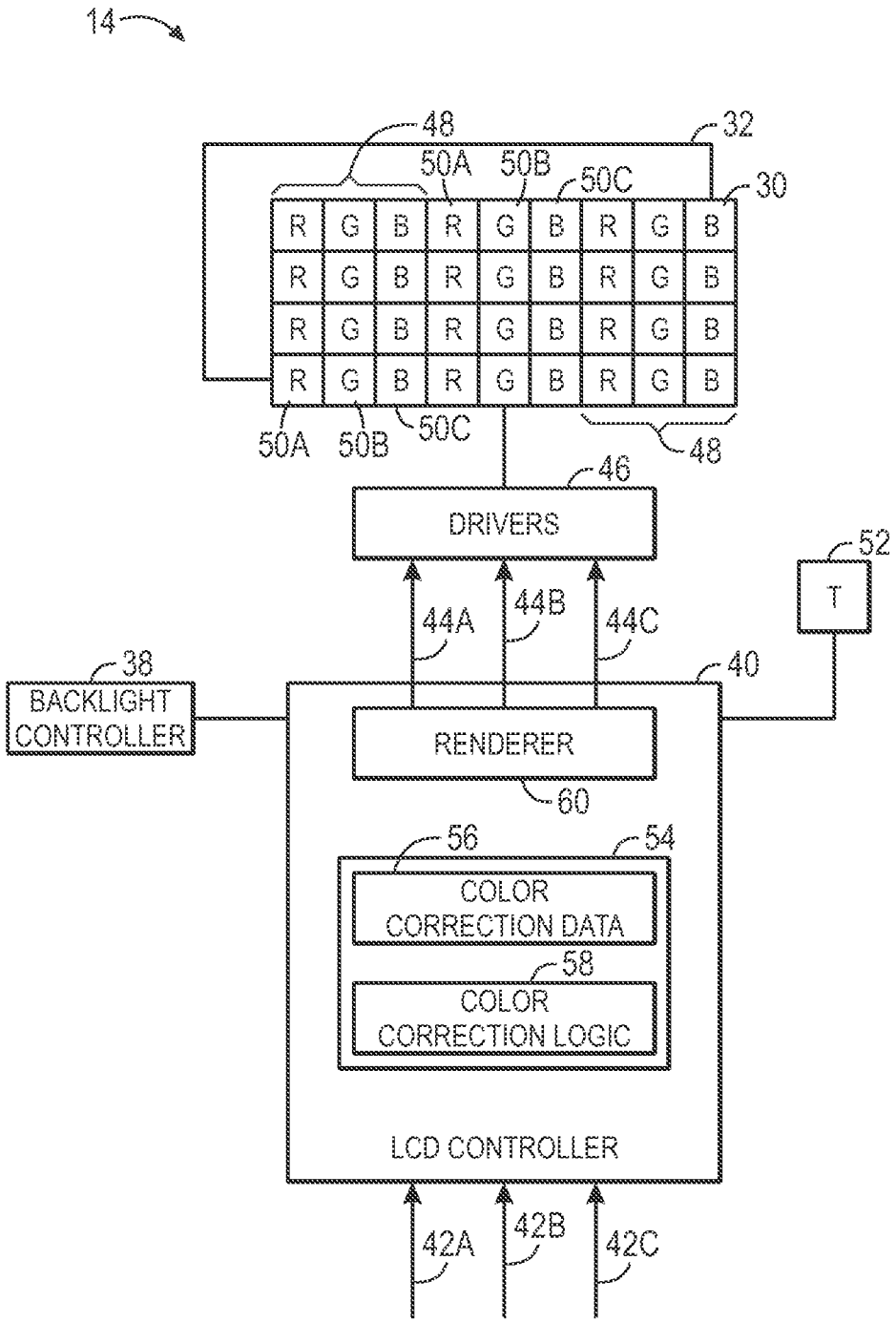
FIG. 4 is a block diagram of an example of components of the display of FIG. 2, in accordance with aspects of the present disclosure.

Additional details of illustrative display 14 may be better understood through reference to FIG. 4, which is a block diagram illustrating various components and features of display 14. Display 14 includes a backlight controller 38 that governs operation of backlight 32. For example, backlight controller 38 may include one or more driver integrated circuits that power and drive light source 36.

Display 14 also includes an LCD controller 40 that governs operation of LCD panel 30. For example, LCD controller 40 may receive image data from device 10 through input channels 42A, 42B, and 42C of display 14. According to certain embodiments, the image data may be sent to display 14 from a graphics card, controller, or processor 22 of device 10 through I/O controller 28 (FIG. 2). Each input channel 42A, 42B, and 42C may correspond to a different color channel of display 14. For example, input channel 42A may be a red channel; input channel 42B may be a green channel; and input channel 42C may be a blue channel. LCD controller 40 may process the image data received through input channels 42A, 42B, and 42C and provide the processed image data to drivers 44 in the form of output signals 44A, 44B, and 44C. Each output signal 44A, 44B, and 44C may represent the processed image data from a corresponding input channel 42A, 42B, and 42C. According to certain embodiments, LCD controller 40 may include control circuitry and/or one or more microprocessors for processing the image data.

The output signals 44A, 44B, and 44C may be provided to one or more drivers 46 that control LCD panel 30 to display the processed image data on display 14. For example, drivers 46 may include one or more driver integrated circuits (e.g., column drivers and row drivers) that change the transmissive state of pixels 48 within LCD panel 30. As shown in FIG. 4, drivers 46 are a separate component from LCD controller 40. However, in other embodiments, drivers 46 may be an integral part of LCD controller 40.

Each pixel 48 includes a set of subpixels 50A, 50B, and 50C, each capable of emitting a discrete color. For example, subpixels 50A may emit red light, subpixels 50B may emit green light, and subpixels 50C may emit blue light. Each subpixel 50A, 50B, and 50C may display image data from the corresponding output signal 44A, 44B, and 44C, respectively. Further, a number of colors may be displayed by each pixel 48 by varying the individual intensity levels of the subpixels 50A, 50B, and 50C.

Display 14 also includes a temperature sensor 52 that detects the temperature of the display. According to certain embodiments, temperature sensor 52 may be disposed on a heat sink of display 14. However, in other embodiments, temperature sensor 52 may be mounted on a substrate of LCD panel 30 or on a substrate of backlight 32. According to certain embodiments, temperature sensor 52 may periodically detect the temperature. For example, in certain embodiments, temperature sensor 52 may detect the temperature at 10-second intervals during operation of display 14. However, in other embodiments, the length of the intervals may vary. Further, in certain embodiments, temperature sensor 52 may detect the temperature at different intervals depending on the currently detected temperature. For example, the temperature sensor 52 may detect the temperature more frequently when the temperature is farther away from the stable operating temperature of display 14.

LCD controller 40 may process the image data based on the detected temperature and based on information stored in a memory 54. For example, LCD controller 40 may use color correction data 56 stored in memory 54 in conjunction with color correction logic 58 to determine color correction values that should be applied to the image data received through each color channel 42A, 42B, and 42C. According to certain embodiments, memory 54 may be an EEPROM, flash memory, or other suitable optical, magnetic, or solid-state computer readable media. As shown in FIG. 4, memory 54 is included within display 14 as part of LCD controller 40. However, in other embodiments, memory 54 may be a standalone component included within display 14. Further, in other embodiments, the color correction data 56 and color correction logic 58 may be stored within a memory of electronic device 10, such as storage 24 (FIG. 2).

The color correction values may represent values that can be applied to the input signals of each color channel 42A, 42B, and 42C to compensate for color shifts in display 14 that are caused by changes in the display temperature. For example, in certain embodiments, the color correction values may be gain coefficients that can be applied to the input signals received through the color channels 42A, 42B, and 42C. A color correction value may be determined for each color channel 42A, 42B, and 42C. For example, a red color correction value may be determined for color channel 42A, a green color correction value may be determined for color channel 42B, and a blue color correction value may be determined for color channel 42C. According to certain embodiments, the color correction values may be designed to compensate for both changes in chromaticity and brightness that occur due to changes in the display temperature.

Further, although the color channels 42A, 42B, and 42C are described herein in the context of a RGB color model, it may be appreciated that in other embodiments, the color adjustment techniques may be applied in the context of other color models, such as the CIE XYZ, HSV, HVL, or CMYK color models. In these embodiments, the number of the color channels, color correction coefficients, and subpixels and/or the specific colors assigned to the color channels, color correction coefficients, and subpixels may vary.

The color correction data 56 may include one or more lookup tables, curves, color models, or the like that can be employed by LCD controller 40 to determine the color correction values. Further, the color correction logic 58 may include hardware and/or software control algorithms or instructions that can be executed by LCD controller 40 to determine the color correction values based on the detected temperature and the color correction data 56. For example, in certain embodiments, LCD controller 40 may retrieve the color correction values from a table, included in the color correction data 56, that correlates the detected temperature to the color correction values for each color channel. In another example, if the detected temperature falls between two temperature values included within the table, LCD controller 40 interpolate the color correction values from the values included in the table. In yet another example, LCD controller 40 may execute the color correction logic 58 to calculate the color correction values by inputting the detected temperature into a color model included within the color correction data 56.

As discussed further below with respect to FIGS. 5-7, the color correction logic 58 also can be employed to incremental adjustments for transitioning the current correction values, which correspond to the previously detected temperature, to the target color correction values, which correspond to the presently detected temperature. In certain embodiments, the color correction logic 58 may be employed to generate intermediate color correction values that can be applied in a series of steps until the target color correction values are reached. The use of intermediate color correction values may allow the color correction values to be gradually adjusted to the target color correction values so that color compensation adjustments are imperceptible to a user. According to certain embodiments, the intermediate color correction values may be employed when a sizable difference exists between the current color correction values and the target color correction values, for example, when the display is resuming operation after a low power mode, such as a sleep more or a standby mode.

LCD controller 40 also includes a renderer 60 that can be employed to apply the color correction values to the input signals received through color channels 42A, 42B, and 42C. For example, renderer 60 may include multipliers that multiply the input signals for each channel by the respective color correction values. In certain embodiments, renderer 60 may include a separate multiplier for each color channel 42A, 42B, and 42C. The renderer 60 may then further process the data, for example, by dithering and/or truncating the data, to produce the output signals 44A, 44B, and 44C that are provided to drivers 46. As discussed above, the drivers 46 can then employ the output signals 44A, 44B, and 44C to display the processed image data on display 14.

Figure 5:
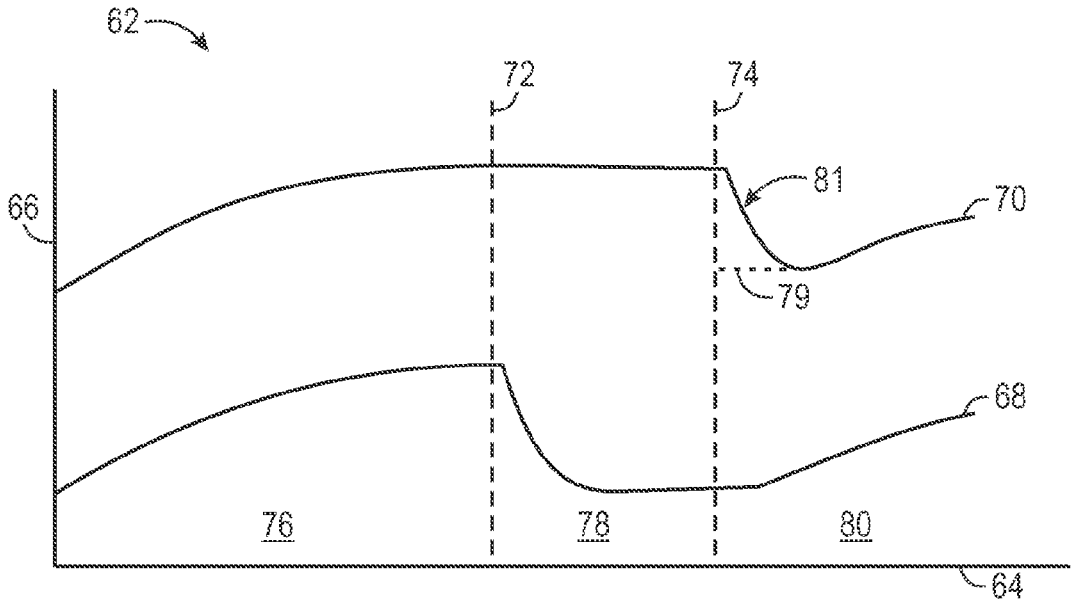
FIG. 5 is a chart depicting a representative change in color correction values and temperature over time, in accordance with aspects of the present disclosure.

FIG. 5 is a chart 62 depicting how the display temperature and color correction values may change over time. Chart 62 includes an x-axis 64 that represents time. Chart 62 also includes a y-axis 66 that represents temperature for curve 68 and color correction values for curve 70. Chart 62 further includes lines 72 and 74 that separate chart 62 into three sections 76, 78, and 80. In particular, section 76 represents a period where the display is beginning operation, such as after startup of the display. Section 78 represents a period where the display is operating in a low power mode, such as a sleep mode or a standby mode, and section 80 represents a period where the display is resuming normal operation after operating in a low power mode.

As shown in section 76, the display temperature, as represented by curve 68, generally increases along a curved profile until a stable operating temperature is reached, just before line 72. As the temperature of the display increases, the LCD controller adjusts the color correction values, represented by curve 70, in a manner that generally corresponds to the changes in the display temperature. Line 72 represents the point in time when the display enters the low power mode, and section 78 represents the period that the display is operating in the low power mode. As shown in section 78, upon entering the low power mode, the display temperature decreases, as shown by curve 68. However, the color correction values, represented by curve 70, remain generally constant. In particular, the display temperature may not be detected while the display is operating in the low power mode, and therefore the display may retain the color correction values that correspond to the temperature that was detected immediately prior to entering the low power mode.

Line 74 represents the point in time when the display exits the low power mode and resumes normal operation. Accordingly, section 80 represents the period when the display is resuming normal operation after a low power mode. As shown by curve 68, the temperature of the display increases when normal operation is resumed. As shown by curve 70, the color correction values also change as the display resumes operation. Dashed line 79 represents the curve the color correction values would follow if the color correction values were immediately adjusted to the target color correction values corresponding to the temperature of the display detected after resuming normal operation. As shown by line 79, immediate adjustment to the target color correction values may result in a dramatic decrease in the color correction values. According to certain embodiments, this change in the color correction values may be perceptible to a user.

Accordingly, rather than immediately adjusting the color correction values, the color correction values may be incrementally adjusted along an adjustment curve 81 that gradually transitions the color correction values to the target color correction values. In particular, the color correction values may be incrementally adjusted to the target color correction values by applying intermediate color correction values that have values between the current color correction values and the target color correction values. The incremental adjustment may gradually transition the color correction values to the target color correction values without a color shift that may be perceived by the user.

Figure 6:
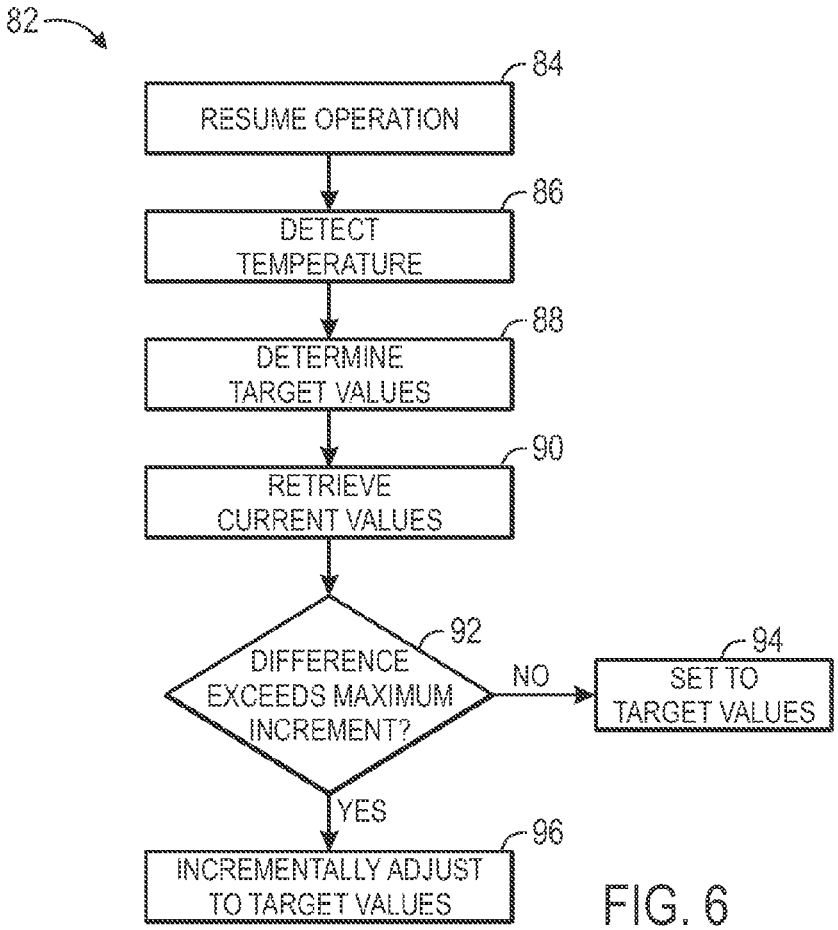
FIG. 6 is a flowchart depicting a method for adjusting color correction values, in accordance with aspects of the present disclosure.
Figure 7:
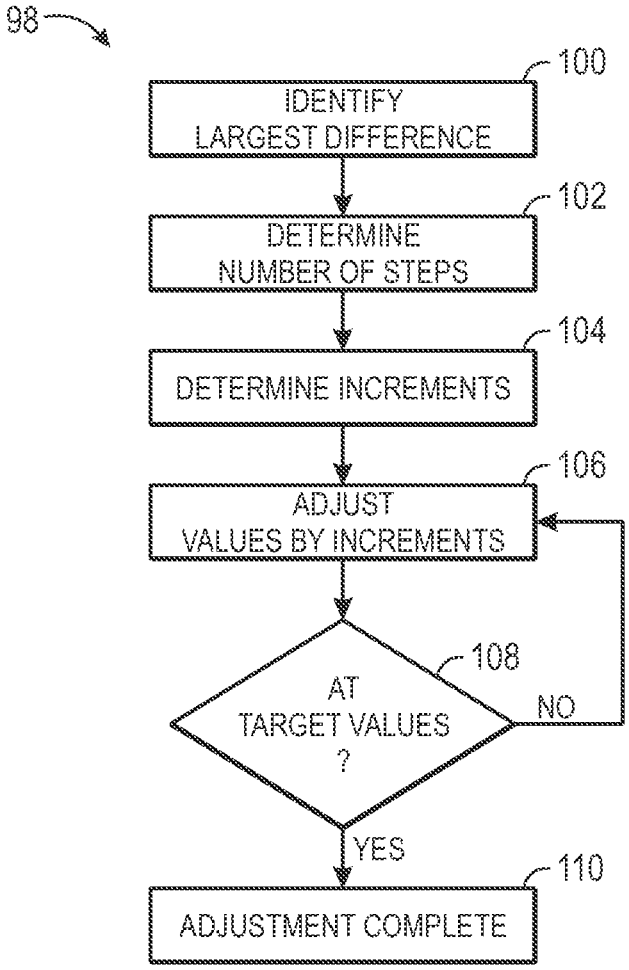
FIG. 7 is a flowchart depicting a method for incrementally adjusting the color correction values, in accordance with aspects of the present disclosure.

FIGS. 6 and 7 depict methods for incrementally adjusting the color correction values to the target color correction values. In particular, FIG. 6 is a flowchart depicting a method 82 for adjusting the color correction values when the display resumes operation after a low power mode. For example, method 82 may be applied to gradually transition the color correction values to the target color correction values along curve 81, as shown in FIG. 5. Although method 82 is described in the context of resuming operation after a low power mode, in other embodiments, the method may be employed to incrementally adjust the color correction values to the target color correction values in response to significant temperature changes that may be caused by other events, such as a change in the display's environment.

Method 82 may begin by detecting (block 84) that the display is resuming operation after a low power mode. For example, LCD controller 40 (FIG. 4) may receive input signals through color channels 42A, 42B, and 42C, which may indicate that normal operation has resumed. The display may then detect (block 86) the temperature of the display. For example, as shown in FIG. 4, temperature sensor 52 may detect the display temperature at set intervals during normal operation of the display and may provide signals indicative of the temperature to LCD controller 40.

The LCD controller may then determine (block 88) the target color correction values based on the detected temperature. For example, LCD controller 40 (FIG. 4) may retrieve color correction values from look up tables stored within memory 54 as color correction data 56. In another example, LCD controller 40 may execute color correction logic 58 to calculate the color correction values based on models included within memory 54 as color correction data 56. LCD controller also may retrieve (block 90) the current color correction values, which were applied just prior to entering the low power mode. For example, LCD controller 40 may retrieve the current color correction values from memory 54.

The LCD controller may then determine (block 92) whether the difference between the current color correction values and the target correction values exceeds a maximum adjustment increment. For example, the maximum increment may represent the maximum shift in the color correction values that can be employed without being perceptible to a user. According to certain embodiments, the maximum adjustment increment may be stored within memory 54 (FIG. 4).

In order to determine whether the difference exceeds a maximum adjustment increment, the LCD controller may calculate the absolute difference between the target color correction value and the current color correction value for each color channel included within the display. For example, as shown in FIG. 4, LCD controller 40 may calculate the difference between the target color correction value and the current color correction value for each of the color channels 42A, 42B, and 42C. The LCD controller may then determine whether any of the differences exceeds the maximum adjustment increment. If none of the differences exceeds the maximum adjustment increment, the LCD controller may set (block 94) the color correction values to the target color correction values. Accordingly, the adjustment to the target color correction values may be preformed in a single step.

On the other hand, if the LCD controller determines that the difference for one or more of the color channels exceeds the maximum adjustment increment, the controller may incrementally adjust (block 96) the color correction values to the target color correction values. For example, as discussed further below with respect to FIG. 7, the LCD controller may set the color correction values for each color channel to one or more intermediate color correction values prior to setting the color correction values to the target color correction values.

FIG. 7 depicts an embodiment of a method 98 for incrementally adjusting the color correction values to the target color correction values. According to certain embodiments, method 98 may be performed as part of block 96 shown in FIG. 6. As discussed above with respect to FIG. 6, method 98 may be employed when the absolute difference between the target color correction values and the current color correction values for one or more of the color channels exceeds the maximum adjustment increment.

Method 98 may begin by identifying (block 100) the color channel that has the largest absolute difference between the current color correction value and the target color correction value. For example, LCD controller 40 (FIG. 4) may determine the absolute differences between the target color correction values and the current color correction values for each of the color channels 42A, 42B, and 42C and may then determine which of the differences is the greatest.

The LCD controller may then determine (block 102) the number of adjustment steps that should be employed to reach the target color correction values based on the largest difference. For example, if the red color channel 42A (FIG. 4) is determined to have the largest difference, the LCD controller may use the difference between the target color correction value and the current color correction value for the red channel 42A to determine the number of adjustment steps. In particular, the LCD controller may divide the difference by the maximum adjustment increment to determine the number of steps that should be employed. In certain embodiments, if the number of steps is not an integer, the LCD controller may select the next largest number of steps.

The LCD controller may then determine (block 104) the size of the adjustment increments for each color channel. For example, the LCD controller may divide the difference between the target color correction value and the current color correction value for each color channel by the number of steps. Accordingly, for the color channel with the largest difference, the adjustment increment size may be approximately equal to, or slightly less than, the maximum adjustment increment. For the other color channels, which have smaller differences, the adjustment increment sizes may be smaller than the adjustment increment size for the color channel with the largest difference. Accordingly, the adjustment increment size may vary between color channels, but the color channels may be adjusted to the target color correction values in the same number of steps.

The LCD controller may then adjust (block 106) the color correction values by the increment size. For example, if the target color correction values are lower then the current color correction values, the LCD controller may decrease each of the color correction values by the increment size for each color channel to arrive at intermediate color correction values. The intermediate color correction values may be applied to output image data on the display, for example, by renderer 60. For example, as described above with respect to FIG. 4, renderer 60 may multiply the input signals received through color channels 42A, 42B, and 42C by the intermediate color correction values to produce output signals 44A, 44B, and 44C that are provided to drivers 46. Drivers 46 may then employ the output signals 44A, 44B, and 44C to display the processed image data on display 14.

The LCD controller may then determine (block 108) whether the color correction values are at the target color correction values. If the values are not at the target values, the LCD controller may again adjust (block 106) the values by another set of adjustment increments. For example, LCD controller 40 may then decrease the previously applied intermediate color correction values by another set of incremental values to arrive either at new intermediate color correction values or at the target color correction values. According to certain embodiments, LCD controller 40 may adjust the color correction values by the incremental amounts after a set time interval. For example, LCD controller 40 may include a timer that is set to adjust the color correction values after set intervals, such as 8-second intervals. However, in other embodiments, the timer may be included within the electronic device 10. Once the target color correction values have been applied, the adjustment may be complete (block 110).

In certain embodiments, the adjustment interval for the timer may be selected so that the greatest expected difference between the current color correction values and the target color correction values can be incrementally adjusted within a target time period, such as 10 seconds. For example, the color correction values that correspond to the highest expected operating temperature during normal operation may be compared to the color correction values that correspond to the lowest expected temperature during the low power mode to determine the greatest expected difference between the current color correction values and the target color correction values. The greatest expected difference can then be divided by the maximum adjustment increment to determine the greatest number of steps that may be expected for adjusting the current color correction values to the target color correction values. The target time period may then be divided by the greatest number of steps to determine the adjustment interval that can be employed by the timer to incrementally adjust the current color correction values to the target color correction values.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A display system, comprising: a display comprising a plurality of color channels each assigned a current color correction value;

a temperature sensor configured to detect a temperature of the display; and a controller configured to:

determine a target color correction value for each of the plurality of color channels based on the temperature; determine, for each of the plurality of color channels, a difference between the target color correction value and the current color correction value; and incrementally adjust each of the plurality of color channels to the respective target color correction value, wherein an adjustment increment for each of the plurality of color channels is determined based on the color channel with a largest difference between the target color correction value and the current color correction value;

wherein the controller is configured to determine a number of steps for incrementally adjusting the color channel with the largest difference to the respective target color correction value, and to determine adjustment increments for each of the other color channels based on the number of steps; and wherein the controller is configured to divide the largest difference by a maximum adjustment increment to determine the number of steps.

2. The display system of claim 1, wherein the plurality of color channels comprises a red color channel, a green color channel, and a blue color channel.

3. The display system of claim 1, wherein the maximum adjustment increment comprises a largest change in color that is generally imperceptible to a user.

4. The display system of claim 1, wherein the controller is configured to adjust each of the plurality of color channels to the respective target color correction values in a same number of steps.

5. The display system of claim 1, wherein the controller is configured to determine intermediate color correction values for adjusting each of the plurality of color channels to the target color correction values.

6. The display system of claim 5, comprising a plurality of multipliers each corresponding to one of the plurality of color channels and configured to multiply input signals for the plurality of color channels by the intermediate color correction values.

7. The display system of claim 1, wherein the display comprises a liquid crystal diode display comprises sets of red, green, and blue subpixels, and wherein each set of subpixels corresponds to a different color channel of the plurality of color channels.

8. A method, comprising:

detecting, via circuitry, a temperature of a display comprising a plurality of color channels each assigned a current color correction value;

determining, via the circuitry, based on the temperature, a target color correction value for each of the plurality of color channels;

determining, via the circuitry, for each of the color channels, a difference between the target color correction value and the current color correction value;

determining, via the circuitry, for each of the color channels, whether a difference between the target color correction value and the current color correction value is greater than a maximum adjustment increment;

determining, via the circuitry, an adjustment increment for each of the color channels based on the color channel with a largest difference between the target color correction value and the current color correction value; and incrementally adjusting, via the circuitry, each of the color channels to the respective target color correction value using the respective adjustment increment, such that each of the color channels may display colors in accordance with the respective target color correction value.

9. The method of claim 8, wherein incrementally adjusting each of the color channels to the respective target color correction value comprises determining intermediate color correction values for each of the color channels, and wherein the intermediate color correction values are offset from the current color correction values by the respective adjustment increments.

10. The method of claim 9, comprising multiplying an input signal for each of the color channels by the respective intermediate color correction value to generate output signals for one or more drivers of the display.

11. The method of claim 8, comprising dividing the largest difference by the maximum adjustment increment to determine a number of steps for adjusting the plurality of color channels to the target color correction values.

12. The method of claim 8, the maximum adjustment increment comprises a largest change in color that is generally imperceptible to a user.

13. The method of claim 8, wherein the plurality of color channels comprises a red color channel, a green color channel, and a blue color channel.

14. A method, comprising:

detecting, via circuitry, a temperature of a display comprising a plurality of color channels each assigned a current color correction value;

determining, via the circuitry, based on the temperature, a target color correction value for each of the plurality of color channels;

determining, via the circuitry, for at least one of the color channels, that a difference between the target color correction value and the corresponding current color correction value is greater than a maximum adjustment increment;

determining, via circuitry, a number of steps for adjusting the current color correction value for the at least one color channel to the corresponding target color correction value, wherein the number of steps is determined so that an adjustment increment for each step is less than or equal to the maximum adjustment increment; and incrementally adjusting, via the circuitry, each of the color channels to the respective target color correction value using the adjustment increment, such that each of the color channels may display colors in accordance with the respective target color correction value.

15. The method of claim 14, comprising resuming normal operation of the display after a low power mode, wherein the temperature is detected after resuming normal operation of the display.

16. The method of claim 14, wherein determining a number of steps comprises dividing the difference by the maximum adjustment increment.

17. The method of claim 14, comprising incrementally adjusting each of the plurality of color channels to the target color correction value in the number of steps.

18. The method of claim 14, comprising dividing, for each of the other color channels, the difference between the current color correction value and the target color correction value by the number of steps to determine an adjustment increment for the other color channels.

19. The method of claim 14, comprising incrementally adjusting the current color correction value to the target color correction value at set time intervals for each of the plurality of color channels.

20. The method of claim 14, wherein the maximum adjustment increment comprises a largest change in color that is generally imperceptible to a user.

* * * * *